US009017030B2

(12) United States Patent
Beeck

(10) Patent No.: US 9,017,030 B2
(45) Date of Patent: Apr. 28, 2015

(54) TURBINE COMPONENT INCLUDING AIRFOIL WITH CONTOUR

(75) Inventor: Alexander R. Beeck, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 488 days.

(21) Appl. No.: 13/280,440

(22) Filed: Oct. 25, 2011

(65) Prior Publication Data

US 2013/0101409 A1 Apr. 25, 2013

(51) Int. Cl.
*F01D 5/14* (2006.01)

(52) U.S. Cl.
CPC ..... *F01D 5/141* (2013.01); *F01D 5/145* (2013.01); *F05D 2240/127* (2013.01)

(58) Field of Classification Search
CPC ..... F05D 2240/302; F05D 2240/127; F01D 5/146; F01D 5/143; F01D 5/141
USPC ..... 416/189, 191, 193 A, 228, 231, 234, 416/235, 236 R; 415/914
See application file for complete search history.

(56) References Cited

U.S. PATENT DOCUMENTS

| | | | | |
|---|---|---|---|---|
| 4,023,350 | A | 5/1977 | Hovan et al. | |
| 4,465,433 | A * | 8/1984 | Bischoff | 416/223 A |
| 4,720,239 | A * | 1/1988 | Owczarek | 416/223 A |
| 6,669,445 | B2 | 12/2003 | Staubach et al. | |
| 7,134,842 | B2 | 11/2006 | Tam et al. | |
| 7,217,096 | B2 | 5/2007 | Lee | |
| 7,220,103 | B2 | 5/2007 | Cunha et al. | |
| 7,354,243 | B2 * | 4/2008 | Harvey | 415/191 |
| 7,465,155 | B2 | 12/2008 | Nguyen | |
| 7,566,203 | B2 | 7/2009 | Moser | |
| 7,625,181 | B2 | 12/2009 | Matsuda et al. | |
| 7,887,297 | B2 | 2/2011 | Allen-Bradley et al. | |
| 8,647,066 | B2 * | 2/2014 | Guimbard et al. | 416/193 A |
| 2004/0081548 | A1 * | 4/2004 | Zess et al. | 415/1 |
| 2006/0140768 | A1 * | 6/2006 | Tam et al. | 416/193 A |
| 2006/0233641 | A1 * | 10/2006 | Lee et al. | 415/208.1 |
| 2007/0258810 | A1 | 11/2007 | Aotsuka et al. | |
| 2010/0158696 | A1 | 6/2010 | Pandey et al. | |
| 2011/0014056 | A1 | 1/2011 | Guimbard et al. | |
| 2011/0044818 | A1 | 2/2011 | Kuhne et al. | |

* cited by examiner

*Primary Examiner* — Dwayne J White
*Assistant Examiner* — Brian P Wolcott

(57) ABSTRACT

A turbine engine airfoil structure including an airfoil adapted to extend across a gas passage, and a platform structure defining an endwall located at one end of the airfoil and positioned at a location forming a boundary of the gas passage. A saddle portion is associated with at least one airfoil surface of the airfoil, the saddle portion defining a contour having a first radially outer edge located on the at least one airfoil surface and a second radially inner edge located radially inwardly from the radially outer edge. The contour includes a curvature in a plane extending generally perpendicular to the at least one airfoil surface and passing through the saddle portion, the curvature being radially spaced from the endwall and defining an apex located between the radially outer and inner edges of the saddle portion.

19 Claims, 5 Drawing Sheets

TURBINE COMPONENT INCLUDING AIRFOIL WITH CONTOUR

FIELD OF THE INVENTION

The present invention relates generally to turbine engines and, more particularly, to a contour structure for turbine engine blades or vanes.

BACKGROUND OF THE INVENTION

A gas turbine engine typically includes a compressor section, a combustor, and a turbine section. The compressor section compresses ambient air that enters an inlet. The combustor combines the compressed air with a fuel and ignites the mixture creating combustion products defining a working fluid. The working fluid travels to the turbine section where it is expanded to produce a work output. Within the turbine section are rows of stationary vanes directing the working fluid to rows of rotating blades coupled to a rotor. Each pair of a row of vanes and a row of blades form a stage in the turbine section.

Advanced gas turbines with high performance requirements attempt to reduce the aerodynamic losses as much as possible in the turbine section. This in turn results in an improvement of the overall thermal efficiency and power output of the engine. One approach to reducing aerodynamic losses is to incorporate endwall contouring on the blade and vane platforms or shrouds in the turbine section.

Endwall contouring when optimized can result in a significant reduction in secondary flow vortices, which vortices may contribute to losses in the turbine stage. In addition, the airfoils of the blades or vanes may be formed with a bow or lean to change passage vortex and/or horseshoe vortex influenced losses in the flow passages between the blades or vanes.

SUMMARY OF THE INVENTION

In accordance with an aspect of the invention, a turbine engine airfoil array is provided comprising a laterally extending endwall with a series of airfoils projecting radially therefrom. Each airfoil has a convex suction surface corresponding to an airfoil suction side and a laterally opposite concave pressure surface corresponding to an airfoil pressure side extending axially in chord between opposite leading and trailing edges. The airfoils cooperate with the endwall to define a series of fluid flow passages for directing flow in a downstream direction from the leading edge toward the trailing edge. A saddle portion is associated with each suction surface, the saddle portion defining a contour having a first radially outer edge located on a respective suction surface and a second radially inner edge located radially inwardly from the radially outer edge. The contour comprises a curvature in a plane extending radially and generally perpendicular to the suction surface and passing through the saddle portion, the curvature being a convexly curved portion and defining an apex located between the radially outer and inner edges of the saddle portion.

In accordance with further aspects of the invention, the saddle portion may be located along a downstream portion of the suction surface. The saddle portion may extend axially along at least a portion of a region of the suction surface defined from about an axial mid-point of the airfoil to the trailing edge.

The saddle portion may include an upstream end and an axially opposite downstream end located at the trailing edge of the airfoil, and the contour defined by the saddle portion may taper radially outwardly from the upstream end to the downstream end.

The apex of the curvature may be located about midway between the radially outer and inner edges of the saddle portion.

The curvature of the contour may further comprise a concavely curved portion in the plane extending radially and generally perpendicular to the suction surface, the concavely curved portion may be contiguous with the convexly curved portion. Further, the concavely curved portion may extend laterally into the suction surface.

The radially inner edge of the saddle portion may be located on the endwall. The apex of the curvature defines a center of curvature, and the center of curvature may be located laterally at or inwardly from the suction surface.

The radially inner edge of the saddle portion may be located radially at or outwardly from a junction of the suction surface with the endwall. The apex of the curvature defines a center of curvature, and the center of curvature may be located radially outwardly from the endwall.

The saddle portion may comprise a first saddle portion, and the airfoil may include a second saddle portion associated with each suction surface. The second saddle portion may define a second contour having a first radially outer edge located on a respective suction surface and a second radially inner edge located radially inwardly from the radially outer edge. Further, the second contour may comprise a second curvature in a plane extending radially and generally perpendicular to the suction surface and passing through the second saddle portion, the second curvature being convexly curved and defining an apex located between the radially outer and inner edges of the second saddle portion.

The suction surface may be radially and axially asymmetrical relative to the pressure surface at the location of the saddle portion.

In accordance with another aspect of the invention, a turbine engine airfoil structure is provided comprising an airfoil adapted to be supported to extend across a gas passage for a hot working gas in a turbine engine. The airfoil has a suction surface corresponding to an airfoil suction side and a laterally opposite pressure surface corresponding to an airfoil pressure side extending axially in chord between opposite leading and trailing edges. A platform structure defines an endwall located at one end of the airfoil and positioned at a location forming a boundary of the gas passage. A saddle portion is associated with at least one of the airfoil surfaces, the saddle portion defining a contour having a first radially outer edge located on the at least one airfoil surface and a second radially inner edge located radially inwardly from the radially outer edge. The contour comprises a curvature in a plane extending generally perpendicular to the at least one airfoil surface and passing through the saddle portion, the curvature being radially displaced from the endwall and defining an apex located between the radially outer and inner edges of the saddle portion.

The curvature may include a convexly curved portion and a concavely curved portion located in radially spaced relation to each other. Further, at least one of the convexly curved portion and the concavely curved portion may be located laterally between the suction surface and the pressure surface.

In accordance with a further aspect of the invention, a height of the saddle portion, defined as a lateral distance from the suction surface to the apex of the curvature defined by the contour, may extend within a range between a maximum height that is about equal to a maximum thickness of the airfoil, defined by a maximum distance between the suction and pressure surfaces, and a minimum height that is about equal to a distance between the suction and pressure surfaces at the trailing edge.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
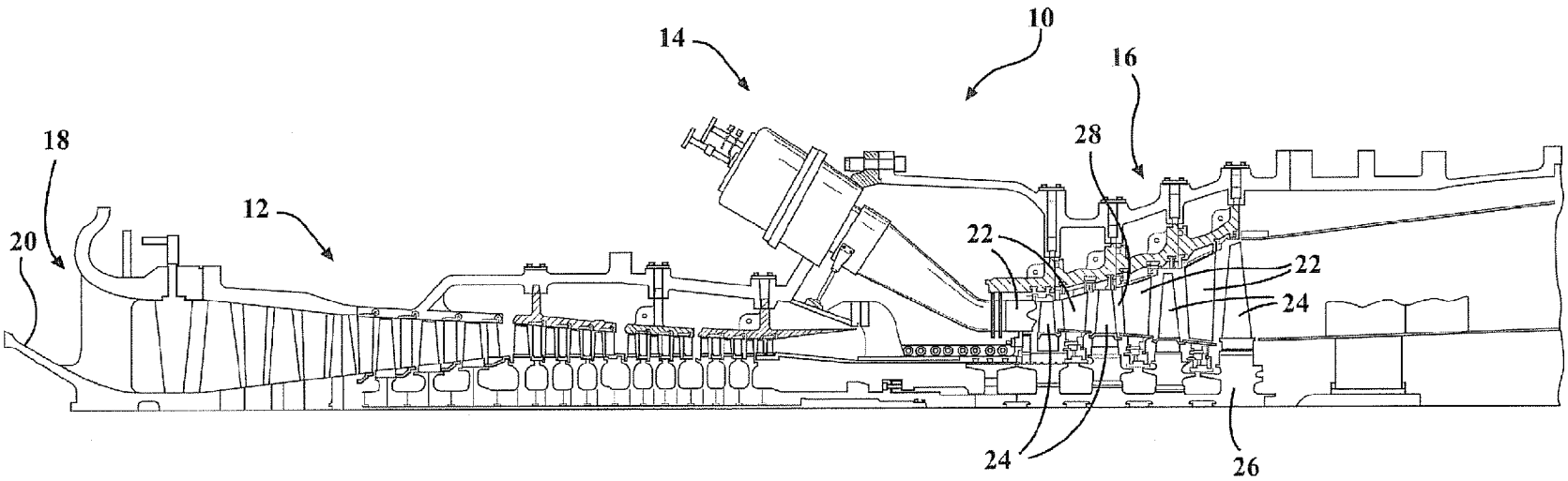
FIG. 1 is a partial cross-sectional view of a gas turbine engine incorporating an airfoil structure formed in accordance with aspects of the present invention.

In FIG. 1 a gas turbine engine 10 is illustrated including a compressor section 12, a combustor 14, and a turbine section 16. The compressor section 12 compresses ambient air 18 that enters an inlet 20. The combustor 14 combines the compressed air with a fuel and ignites the mixture creating combustion products comprising a hot working gas defining a working fluid. The working fluid travels to the turbine section 16. Within the turbine section 16 are rows of stationary vanes 22 and rows of rotating blades 24 coupled to a rotor 26, each pair of rows of vanes 22 and blades 24 forming a stage in the turbine section 16. The rows of vanes 22 and rows of blades 24 extend radially into an axial flow path 28 extending through the turbine section 16. The working fluid expands through the turbine section 16 and causes the blades 24, and therefore the rotor 26, to rotate. The rotor 26 extends into and through the compressor 12 and may provide power to the compressor 12 and output power to a generator (not shown).

Figure 2:
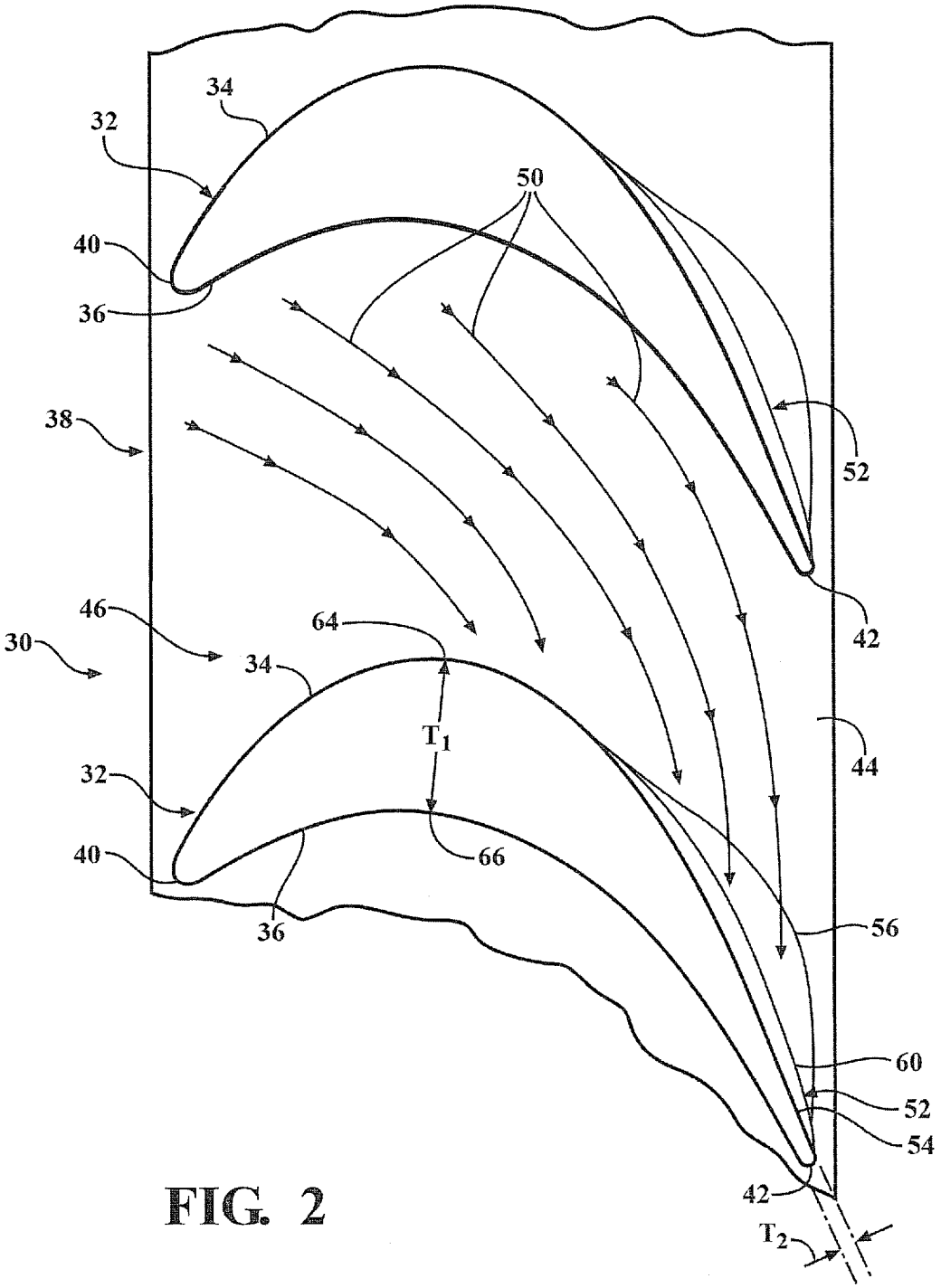
FIG. 2 is a plan view of a portion of an airfoil array of a turbine stage, illustrating aspects of the invention.

Referring to FIG. 2, an airfoil structure 30 comprising one or more of the blades of the row of blades 24 is illustrated for the purpose of describing aspects of the present invention. However, it should be understood that the following description is not limited to implementation on an airfoil structure comprising blades, and the described aspects of the invention may be implemented on other airfoil structures, such as may be implemented on one or more vanes of the row of vanes 22.

Further, it should be understood that the terms "inner", "outer", "radial", "axial", "lateral", and the like, as used herein, are not intended to be limiting with regard to an orientation or particular use of the elements recited for aspects of the present invention.

The airfoil structure 30, as seen in plan view in FIG. 2 looking radially inwardly, includes an array of airfoils 32 adapted to be supported to extend radially across the flow path 28. Each airfoil 32 includes a generally convex suction surface 34 corresponding to an airfoil suction side, and includes a laterally opposing generally concave pressure surface 36 corresponding to an airfoil pressure side. The suction and pressure surfaces 34, 36 extend radially outwardly from a shroud or platform structure 38, see FIGS. 3 and 4, and extend generally axially in a chordal direction between a leading edge 40 and a trailing edge 42 of the airfoil 32. The platform structure 38 is located at one end of the airfoils 32 and defines a laterally extending endwall 44 positioned at a location where it forms a boundary, i.e., an inner boundary, defining a portion of the flow path 28 for the working fluid. In addition, the adjacent airfoils 32 cooperate with the endwall 44 to define a series of fluid flow passages 46 extending between the adjacent airfoils 32 for directing the flow of working fluid in a downstream direction, i.e., in a direction from the leading edge 40 toward the trailing edge 42.

The airfoil 32 is rigidly supported to the platform structure 38. As may be further seen in FIG. 4, the endwall 44 extends generally perpendicular from a junction with the airfoil 32. A junction structure, such as a concave fillet joint 48, may be provided extending from one or both of the surfaces 34, 36 to the endwall 44. The fillet joint 48 provides a connection with a predetermined concave radius that may limit or reduce a stress concentration that may occur at the structural connection defined at the junctions between the airfoil 32 and the endwall 44, and thus may facilitate increasing the life of the airfoil structure 30. However, in accordance with aspects of the present invention, predetermined locations along the junctions between the airfoil 32 and the endwall 44 may be provided with other structure for reducing vortex influenced losses associated with boundary layer flow 50 in the flow passages 46 from the pressure surface 36 of one airfoil 32 toward the suction surface 34 of an adjacent airfoil 32, as illustrated in FIG. 2 and as is described further below.

Figure 3:
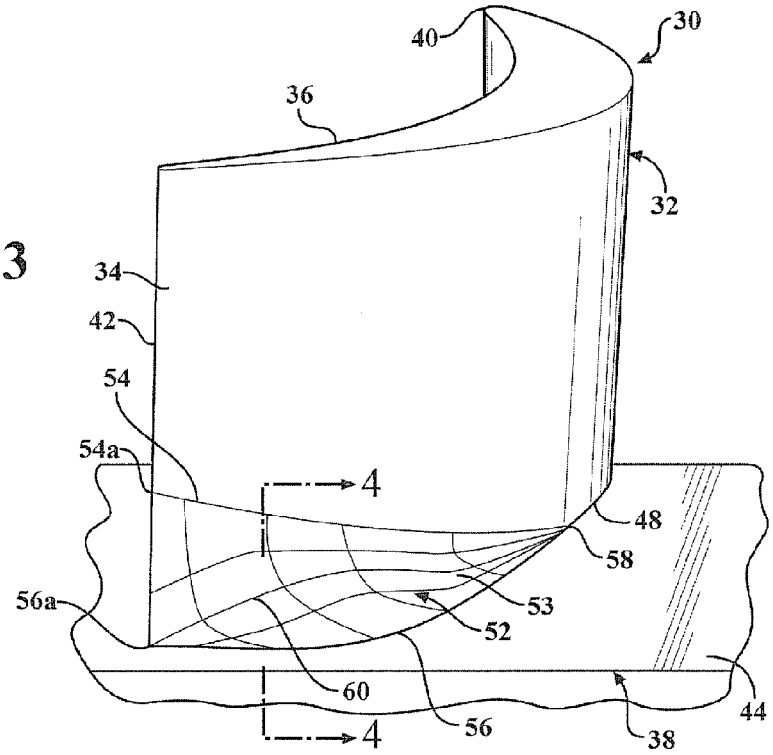
FIG. 3 is a perspective view of an airfoil structure including a configuration of a vortex weakening structure illustrating aspects of the invention.
Figure 4:
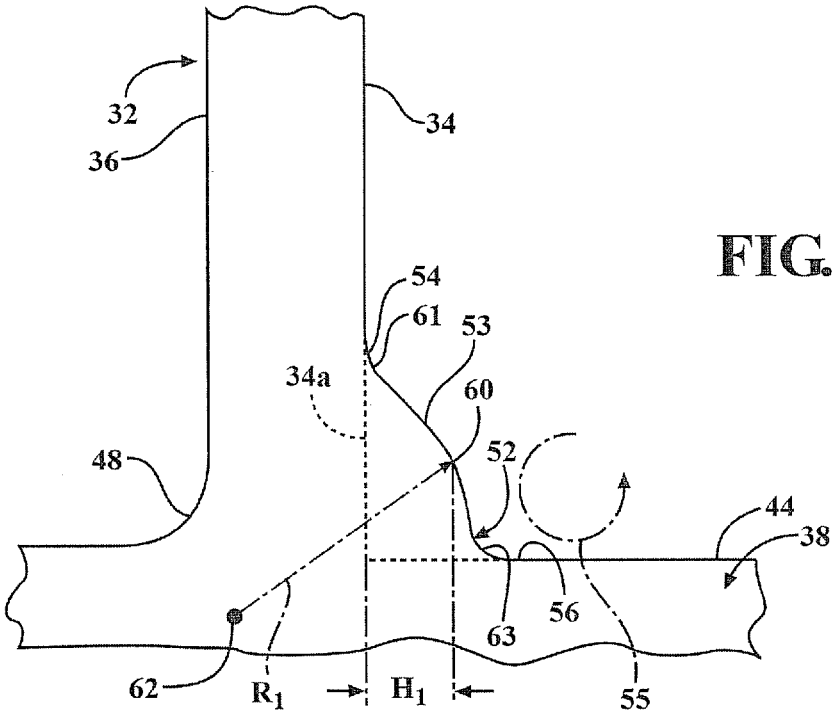
FIG. 4 is a cross-sectional view taken along line 4-4 in FIG. 3.

Referring to FIGS. 3 and 4, in accordance with an aspect of the invention the airfoil structure 30 includes a vortex weakening structure comprising a hump or saddle portion 52. The saddle portion 52 is illustrated as being associated with the suction surface 34 and, as is illustrated in FIGS. 3-6, defines a contour 53 extending laterally outwardly from the suction surface 34. That is, the contour 53 of the saddle portion 52 has a substantial dimension that extends generally perpendicular to the radial or span dimension of the airfoil 32.

It should be understood that although aspects of the invention described with reference to FIGS. 3-6 are described with reference to a saddle portion 52 having a convex shape that extends laterally outwardly from an outer wall of the airfoil 32, such as is defined by the suction and pressure surfaces 34, 36, other configurations of the saddle portion may comprise concave shapes, as is described further below with reference to FIGS. 7 and 8. Additionally, although aspects of the invention are described with particular reference to applications on the suction surface 34, the aspects of the invention may be applied in an analogous manner to the pressure surface 36.

The contour 53 defined by the saddle portion 52 includes a first radially outer edge 54 located on the suction surface 34, and a second radially inner edge 56. The radially outer and inner edges 54, 56 extend generally in the chordal or axial direction to define elongated axially extending boundaries of the contour 53. As seen in FIG. 3, the radially outer and inner edges 54, 56 may diverge extending downstream from a substantially common upstream point 58 on the suction surface 34 to define the contour 53 as having a radially outwardly tapering configuration extending downstream from an upstream end defined by the upstream point 58. As may be further seen in FIG. 2, the upstream point may be positioned at a location that is substantially mid-chord along the axial length of the airfoil 32, such that the saddle portion 52 is substantially provided within a region of the airfoil suction surface 34 that is downstream from an axial midpoint of the airfoil 32.

A downstream end of the contour 53 may be defined between respective radially spaced downstream ends 54*a*, 56*a* of the radially outer and inner edges 54, 56. The radially outer end 54*a* may be located a substantial distance radially outwardly from endwall 44 at or adjacent to the trailing edge 42, and the radially inner end 56*a* may be located at or adjacent to the endwall 44 at or adjacent to the trailing edge 42. As may be seen in FIG. 4, at other axial locations of the radially inner edge 56, the contour 53 defined by the saddle portion 52 may intersect the endwall 44 at locations that are laterally spaced from the suction surface 34.

The contour 53 comprises a curvature in a plane extending generally perpendicular to the suction surface 34 and passing through the saddle portion 52, i.e., a curvature in a plane as defined by line 4-4 in FIG. 3. The profile of the curvature may be seen in FIG. 4. The curvature of the contour 53 is convexly curved outwardly from the suction surface 34, and may additionally include a component of curvature in a direction outwardly from the endwall 44, to define an apex 60 located between the radially outer and inner edges 54, 56 of the saddle portion 52. Further, outer and inner sections 61, 63 of the saddle portion 52 extending from the respective radially outer and inner edges 54, 56 toward the apex 60 may comprise generally concave portions of the contour 53. In particular, the outer and inner sections 61, 63 may define smooth transitions from the respective suction surface 34 and endwall 44 to connect to the apex 60.

Referring to FIG. 4, the apex 60 of the curvature is illustrated located about midway between the radially outer and inner edges 54, 56, although the apex 60 may be provided at other locations between the edges 54, 56, wherein the particular location of the apex 60 may be selected to obtain a desired profile for effecting a reduction or weakening of vortices 55 traveling radially along the suction surface 34 and/or traveling along the endwall 44 adjacent to the suction surface 34. The apex 60 defines a center of curvature 62 located a distance $R_1$ from the apex 60 equal to the radius of curvature for the contour at the apex 60. As illustrated in FIG. 4, the center of curvature 60 is located laterally inwardly from the suction surface 34, i.e., in a lateral direction toward the pressure surface 36.

It should be understood that locations described with reference to the suction surface 34 are made with reference to a generally continuous wall surface defined with reference to the portion of the suction surface 34 outside of the boundaries of the saddle portion 52. For example, the location of the suction surface 34, used for reference of lateral directions and locations, may comprise the portion of the suction surface 34 outside the boundaries of the saddle portion 52, as well as an imaginary continuation surface 34*a* extending radially and axially as a continuation of the suction surface 34 behind the saddle portion 52.

The location of the center of curvature 60 for the configuration illustrated in FIGS. 3 and 4 corresponds to the aspect of the invention in which the saddle portion 52 comprises a feature of a side of the airfoil 32, as opposed to a feature of the endwall 44, and is defined by a radius of curvature for the apex 60 having a substantial component in the lateral direction. Further, in accordance with this aspect of the saddle portion 52, along an entire or a substantial axial extent of the saddle portion 52, a radial dimension of the contour 53, as measured from the radial location of the endwall 44 to the radially outer edge 54, may be equal to or greater than a lateral dimension of the contour 53, as measured from the suction surface 34 (34*a*) to the radially inner edge 56 where it intersects the endwall 44. Hence, the saddle portion 52 may be characterized by a contour 53 having a substantial radial extent modifying the suction surface 34 to provide a flow modification to fluid flows having a substantial radial component passing along the suction surface 34, such as flows including secondary vortices 55.

Referring to FIG. 4, the saddle portion 52 may have a height defined by the lateral dimension $H_1$, as measured from the suction surface 34 (34*a*) to the apex 60 of the contour 53. In accordance with another aspect of the invention, the lateral dimension $H_1$ may preferably be within a range between a maximum and a minimum height. The maximum height is preferably about equal to a maximum thickness of the airfoil 32, defined by a maximum distance between the suction and pressure surfaces 34, 36, such as the distance $T_1$ between the suction and pressure surfaces 34, 36 at corresponding apex locations 64, 66 of the airfoil 32, see FIG. 2. The minimum height is about equal to a distance $T_2$ between the suction and pressure surfaces 34, 36 at the trailing edge 42.

Figure 5:
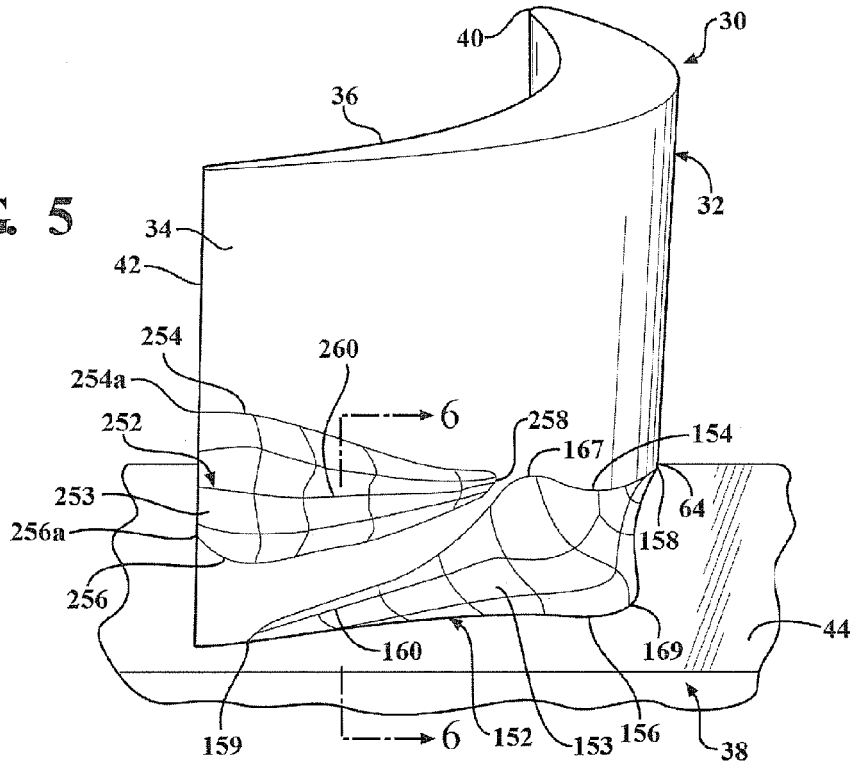
FIG. 5 is a perspective view of an airfoil structure including another configuration of a vortex weakening structure illustrating aspects of the invention.
Figure 6:
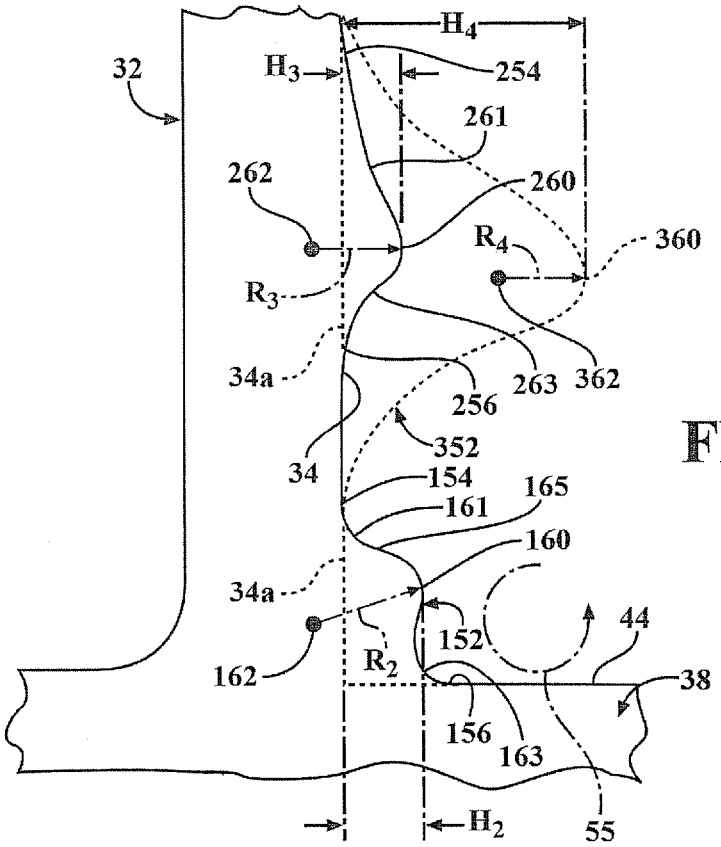
FIG. 6 is a cross-sectional view taken along line 6-6 in FIG. 5.

Referring to FIGS. 5 and 6, a further aspect of the invention is illustrated located on the airfoil 32, and including first and second saddle portions 152, 252 provided to work in conjunction with each other to reduce or weaken vortex influenced losses associated with the boundary layer flow 50 in the flow passages 46, see FIG. 2. Components of the first and second saddle portions 152, 252 corresponding to the saddle portion 52 described with reference to FIGS. 3 and 4 are labeled with the same reference numbers increased by 100 and 200, respectively. Hence, only structure of the saddle portions 152, 252 that differ or are modified from the earlier described saddle portion 52 will be described in detail.

The first saddle portion 152 is formed with a configuration substantially similar to that of the saddle portion 52, including a radially outer edge 154 located on the suction surface 34 and a radially inner edge 156 located on the endwall 44. As seen in FIG. 5, the radially outer and inner edges 154, 156 may diverge extending downstream from a substantially common upstream point 158 on the suction surface 34 to define the contour 153 as having a radially outwardly tapering configuration extending downstream from an upstream end defined by the upstream point 158. The upstream point 158 may be positioned at a location that may be mid-chord along the axial length of the airfoil 32 or may be slightly upstream adjacent to the apex 64 of the suction surface 34 of the airfoil 32. Further, the contour may taper radially inwardly to a downstream point 159, where the radially outer and inner edges 154, 156 converge to a substantially common point adjacent to the trailing edge 42. As illustrated in FIG. 5, the contour 153 may be configured such that the radial extent of the contour 153 increases to a maximum, as indicated by point 167, and the lateral extent increases to a maximum, as indicated by point 169, before converging to the downstream point 159.

Further, outer and inner sections 161, 163 of the saddle portion 152 extending from the respective radially outer and inner edges 154, 156 toward the apex 160 may comprise generally concave portions of the contour 153. In particular, the outer and inner sections 161, 163 may define smooth transitions from the suction surface 34 to connect to the apex 160 on opposing radial sides of the saddle portion 152.

As seen in FIG. 6, the portion of the contour 153 extending from the radially outer edge 154 on the suction surface 34 to the apex 160 has a substantial lateral component and a minimal radial component to define a radially outwardly facing ledge 165, and the portion of the contour 153 extending from the radially inner edge 156 on the endwall 44 to the apex 160 has a substantial radial component and a minimal lateral component, such that the contour defines a relatively abrupt step between the suction surface 34 and the endwall 44 to disrupt vortex flow passing between the endwall 44 and the suction surface 34 and thereby reduce or weaken vortex influenced losses.

As seen in FIG. 6, the apex 160 is located about midway between the radially outer and inner edges 154, 156 along the contour 153 of the saddle portion 152, but is radially located substantially closer to the radial location of the radially outer edge 154 than to the radially inner edge 156. The apex 160 defines a center of curvature 162 located a distance $R_2$ from the apex 160 equal to the radius of curvature for the contour at the apex 160. The center of curvature 162 of the apex 160 is located laterally inwardly from the suction surface 34 and is further located radially outwardly from the endwall 44.

The location of the center of curvature 160 for the configuration illustrated in FIGS. 5 and 6 corresponds to the aspect of the invention in which the saddle portion 152 comprises a feature of a side of the airfoil 32, as opposed to a feature of the endwall 44, and is defined by a radius of curvature for the apex 160 having a substantial component in the lateral direction. Further, in accordance with this aspect of the saddle portion 152, along an entire or a substantial axial extent of the saddle portion 152, a radial dimension of the contour 153, as measured from the radial location of the endwall 44 to the radially outer edge 154, may be equal to or greater than a lateral dimension of the contour 153, as measured from the suction surface 34 (34*a*) to the radially inner edge 156 where it intersects the endwall 44. Hence, the saddle portion 152 may be characterized by a contour 253 having a substantial radial extent modifying the suction surface 34 to provide a flow modification to fluid flows having a substantial radial component passing along the suction surface 34, such as flows including secondary vortices 55.

The saddle portion 152 may have a height defined by the lateral dimension $H_2$, as measured from the suction surface 34 (34*a*) to the apex 160 of the contour 153. In accordance with another aspect of the invention, the lateral dimension $H_2$ may preferably be within a range between a maximum and a minimum height. The range for the height $H_2$ may be substantially as described above for the height $H_1$ of the apex 60 of the contour 53. That is, the height $H_2$ may extend within a range between a maximum height of $T_1$ and a minimum height of $T_2$, as defined above with reference to the airfoil thickness described with reference to FIG. 2.

As seen in FIGS. 5 and 6, the second saddle portion 252 is generally defined at a located that is radially outwardly from the first saddle portion 152. The second saddle portion 252 is formed with a radially outer edge 254 located on the suction surface 34 and a radially inner edge 256 that is also located on the suction surface 34. As seen in FIG. 5, the radially outer and inner edges 254, 256 may diverge extending downstream from a substantially common upstream point 258 on the suction surface 34 to define the contour 253 as having a radially outwardly tapering configuration extending downstream from an upstream end defined by the upstream point 258. The upstream point 258 may be positioned at a location that may be at or downstream from mid-chord along the axial length of the airfoil 32. In alternative configurations of the saddle portion 252, the upstream point 258 of the contour 253 may be at or slightly upstream from the mid-chord on the airfoil 32.

A downstream end of the contour 253 may be defined between respective radially spaced downstream ends 254*a*, 256*a* of the radially outer and inner edges 254, 256. The radially outer and inner ends 254*a*, 256*a* may be located a substantial distance radially outwardly from endwall 44 at or adjacent to the trailing edge 42.

Further, outer and inner sections 261, 263 of the saddle portion 252 extending from the respective radially outer and inner edges 254, 256 toward the apex 260 may comprise generally concave portions of the contour 253. In particular, the outer and inner sections 261, 263 may define smooth transitions from the suction surface 34 to connect to the apex 260 on opposing radial sides of the saddle portion 252.

As seen in FIG. 6, the apex 260 is located about midway between the radially outer and inner edges 254, 256 along the contour 253 of the saddle portion 252. The apex 260 defines a center of curvature 262 located a distance $R_3$ from the apex 260 equal to the radius of curvature for the contour at the apex 260. The center of curvature 262 of the apex 260 is located laterally inwardly from the suction surface 34 and is further located radially outwardly from the endwall 44.

The location of the center of curvature 260 for the configuration illustrated in FIGS. 5 and 6 corresponds to the aspect of the invention in which the saddle portion 252 comprises a feature of a side of the airfoil 32, which is defined by a radius of curvature for the apex 260 having a substantial component in the lateral direction. Further, the saddle portion 252 may be characterized by a contour 253 having a substantial radial extent modifying the suction surface 34 to provide a flow modification to fluid flows having a substantial radial component passing along the suction surface 34, such as flows including secondary vortices 55.

The saddle portion 252 may have a height defined by the lateral dimension $H_3$, as measured from the suction surface 34 (34*a*) to the apex 260 of the contour 253. In accordance with another aspect of the invention, the lateral dimension $H_3$ may preferably be within a range between a maximum and a minimum height. The range for the height $H_3$ may be substantially as described above for the height $H_1$ of the apex 60 of the contour 53. That is, the height $H_3$ may extend within a range between a maximum height of $T_1$ and a minimum height of $T_2$, as defined above with reference to the airfoil thickness described with reference to FIG. 2.

Referring to FIG. 6, a further alternative saddle portion 352 is shown comprising an alternative configuration to the saddle portion 252. The saddle portion 352 defines a contour 353 that is generally similar to the shape of the contour 253, but is formed with a substantially greater height $H_4$, as measured from the suction surface 34 (34*a*) to an apex 360, that is closer to the maximum height, as defined by $T_1$.

The apex 360 defines a center of curvature 362 located a distance $R_4$ from the apex 360 equal to the radius of curvature for the contour at the apex 360. The center of curvature 362 of the apex 360 is located laterally outwardly from the suction surface 34 and is further located radially outwardly from the endwall 44. The location of the center of curvature 360, i.e., located radially outwardly from the endwall 44, corresponds to the aspect of the invention in which the saddle portion 352 comprises a feature of a side of the airfoil 32, which is defined by a radius of curvature for the apex 360 having a substantial component in the lateral direction.

Although the saddle portions 252, 352 are illustrated as generally symmetrical, it should be understood that the saddle portions 252, 352 may be provided with an asymmetrical configuration with reference to the portions on either radial side of the respective apices 260, 360 in order to obtain a desired effect on the flow passing along the side of the airfoil 32. It may also be noted that in referring to a center of curvature for the apex 60, 160, 260, 360, a local center of curvature at an outermost lateral location of the saddle portion 52, 152, 252, 352 is referenced and that variations in the curvature, or radius of curvature, may be provided on either radial side of the apex 60, 160, 260, 360.

Figure 7:
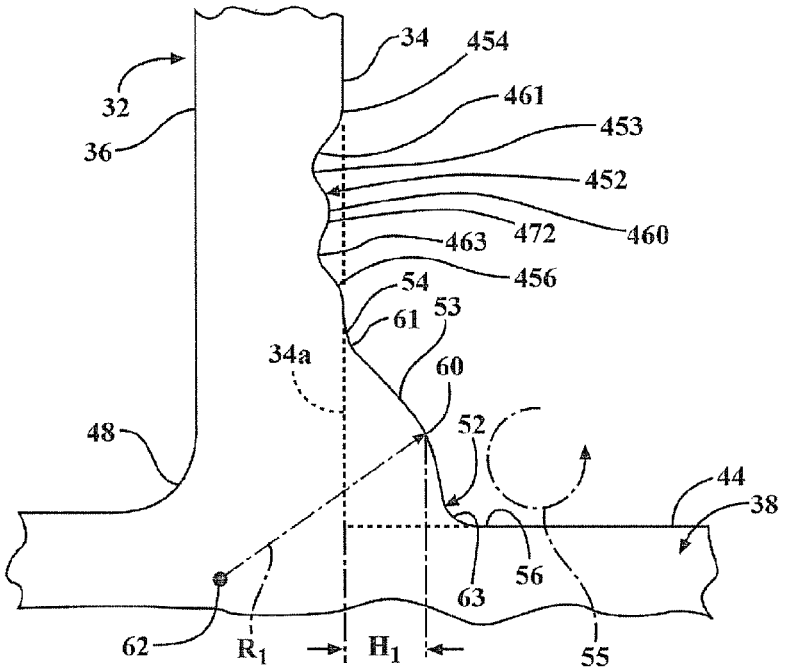
FIG. 7 is a cross-sectional view similar to FIG. 4 showing a variation on aspects of the present invention.
Figure 8:
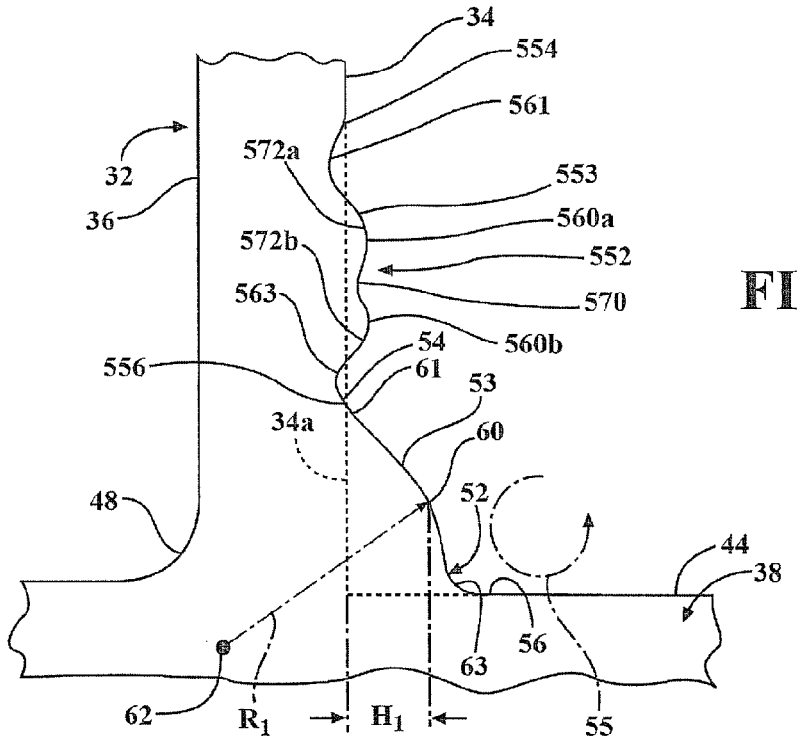
FIG. 8 is a cross-sectional view similar to FIG. 4 showing a further variation on aspects of the present invention.

Referring to FIGS. 7 and 8, further variations on aspects of the present invention are illustrated in relation to the saddle portion 52 shown in FIG. 4, although it may be understood that these variations are not limited to applications in association with the saddle portion 52 as illustrated in FIG. 4. FIG. 7 illustrates a saddle portion 452 in a concave configuration extending laterally inwardly from the suction surface 34 and located radially outwardly from the endwall. The saddle portion 452 may be defined by a curved contour 453 extending radially between outer and inner edges 454, 456 within a plane extending radially and generally perpendicular to the suction surface 34.

The contour of the saddle portion 452 may comprise outer and inner concave sections 461, 463 located on either side of a convex portion 472 defining an apex 460. The concave sections 461, 463 may be defined laterally within or inwardly from the suction surface 34. Further, the outer and inner concave sections 461, 463 may be connected to the outer wall at the respective outer and inner edges 454, 456, wherein the outer and inner edges 454, 456 may comprise convexly curved portions formed for smoothly transitioning to the suction surface 34. It may be noted a center of curvature is defined for each of the curved portions formed at the convex outer and inner edges 454, 456, and for the concave sections 461, 463 and the convex portion 472, and each of these centers of curvature is located in radially spaced relation to the endwall 44, i.e., is located at a radial location associated with the airfoil suction surface 34. Further, as illustrated in the present configuration of the contour 452, the apices defining the saddle portion 452 may be located at lateral locations that include either laterally inwardly or laterally outwardly from the outer wall of the airfoil 32.

As seen in FIG. 7, the saddle portion 452 is entirely defined within the suction surface 34. However, it may be understood that the configuration of the contour 453 may be varied depending on a desired effect on the flow characteristics. For example, the convex portion 472 of the saddle portion 452 may be configured to extend outwardly to position the apex 460 laterally outwardly from the suction surface 34. It may also be noted that the suction surface 34 of the airfoil 32 may be formed with an additional thickness, or built up areas, to accommodate the lateral extension of the saddle portion 452 into the area between the suction surface 34 and the pressure surface 36.

Referring to FIG. 8, an alternative saddle portion 552 is illustrated defined by a contour 553 extending radially between outer and inner edges 554, 556. The contour 553 may comprise an undulating surface, a portion of which may be located laterally inwardly from the suction surface 34, and a portion of which may be located laterally outwardly from the suction surface 34. In particular, the contour 553 of FIG. 8 may comprise a continuation of the contour 53, extending laterally within the suction surface 34, starting at the inner edge 556 and extending to a concave section 563 of the contour 553. At the radially outer edge 554 of the contour 553, the contour 553 may comprise a convex curvature transitioning from the suction surface 34 to a concave section 561 located laterally inwardly from the suction surface 34. The contour 553 further includes a plurality of convex portions defined between the concave sections 561, 563, and is illustrated herein as including two convex portions 572*a*, 572*b* defining a pair of apices 560*a*, 560*b* and separated by a concave portion 570. In the illustrated configuration of FIG. 8, the convex portions 572*a*, 572*b* and the concave portion 570 may be located laterally outwardly from the suction surface 34.

Hence, from the configurations illustrated in FIGS. 7 and 8 it may be seen that the contours provided to the airfoil 32 of the present invention may at least partially extend into the outer wall of the airfoil 32, i.e., into the suction surface 34 or pressure surface 36. In the case of providing laterally inwardly extending contours, the contours may have a smaller lateral dimension than outwardly extending contours to limit or minimized the effect of the inwardly extending contour on the durability of the airfoil 32.

As may be apparent from the above description, alternative configurations for the saddle portions 52, 152, 252, 352, 452, 552 may be provided, other than those specifically described herein. Further, various characteristics from the different contours 53, 153, 253, 353, 453, 553 of the saddle portions 52, 152, 252, 352, 452, 552 may be combined to obtain the aspects of the invention described herein. In particular, the saddle portions 52, 152, 252, 352, 452, 552 or saddle portions provided in accordance with the present description, may include various configurations associated with the radially extending sides of the airfoil 32 to weaken vortices and reduce flow losses, such as by disturbing flow, or beneficially influencing flow, along the suction surface 34 or in the adjacent mainflow to reduce the effect of secondary vortices.

Additionally, it should be apparent that the configuration described for the suction surface 34 may be provided independently of any configuration or shape provided to the pressure surface 36, such that the configuration of the suction surface 34, including one or more saddle portions 52, 152, 252, 352, 452, 552 may be radially and axially asymmetrical relative to the pressure surface 36. Hence, contours provided to the suction surface 34 and/or to the pressure surface 36 may be specifically configured to address particular flow conditions associated with that surface.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine engine airfoil array comprising:

a laterally extending endwall with a series of airfoils projecting radially therefrom, each airfoil having a convex suction surface corresponding to an airfoil suction side and a laterally opposite concave pressure surface corresponding to an airfoil pressure side extending axially in chord between opposite leading and trailing edges;

the airfoils cooperating with the endwall to define a series of fluid flow passages for directing flow in a downstream direction from the leading edge toward the trailing edge;

a saddle portion associated with each suction surface, the saddle portion defining a contour having a first radially outer edge located on a respective suction surface and a second radially inner edge located radially inwardly from the radially outer edge;

wherein the contour comprises a curvature in a plane extending radially and generally perpendicular to the suction surface and passing through the saddle portion, the curvature being a convexly curved portion and defining an apex located between the radially outer and inner edges of the saddle portion, wherein the apex of the curvature defines a center of curvature lying in the plane extending radially and generally perpendicular to the suction surface, and the center of curvature is located laterally at or inwardly from the suction surface in a lateral direction toward the pressure surface;

wherein the radially inner edge of the saddle portion is located on the endwall, and wherein the contour comprises an inner section extending from the radially inner edge toward the apex and an outer section extending from the radially outer edge toward the apex, the inner and the outer sections each defining a radial dimension measured in a direction from the radially inner edge to the radially outer edge of the saddle portion and lying in the plane extending radially and generally perpendicular to the suction surface and a lateral dimension measured in a direction from the suction surface to the radially inner edge on the endwall and lying in the plane extending radially and generally perpendicular to the suction surface, wherein the radial dimension of the inner section is greater than the lateral dimension of the inner section, and the lateral dimension of the outer section is greater than the radial dimension of the outer section.

2. The airfoil array of claim 1, wherein the saddle portion is located along a downstream portion of the suction surface.

3. The airfoil array of claim 2, wherein the saddle portion extends axially along at least a portion of a region of the suction surface defined from about an axial midpoint of the airfoil to the trailing edge, the radially outer and inner edges of the contour diverging in a radial direction from a substantially common upstream point located adjacent to the midpoint of the airfoil and at a junction of the suction surface and the endwall, wherein the radially outer and inner edges extend to a maximum radial dimension adjacent to the trailing edge.

4. The airfoil array of claim 1, wherein the curvature of the contour further comprises a concavely curved portion in the plane extending radially and generally perpendicular to the suction surface, the concavely curved portion being contiguous with the convexly curved portion.

5. The airfoil array of claim 4, wherein the concavely curved portion is defined laterally within or inwardly from the suction surface as defined by a continuous wall surface outside of a boundary of the saddle portion.

6. The airfoil array of claim 1, wherein the radially inner edge of the saddle portion is located radially at the suction surface at a junction of the suction surface with the endwall.

7. The airfoil array of claim 1, wherein the saddle portion comprises a first saddle portion, and the airfoil including a second saddle portion associated with each suction surface, the second saddle portion defining a second contour having a first radially outer edge located on a respective suction surface and a second radially inner edge located on the respective suction surface and located radially inwardly from the radially outer edge; and wherein the second contour comprises a second curvature in a plane extending radially and generally perpendicular to the suction surface and passing through the second saddle portion, the second curvature being convexly curved and defining an apex located between the radially outer and inner edges of the second saddle portion.

8. The airfoil array of claim 1, wherein the suction surface is radially and axially asymmetrical relative to the pressure surface at the location of the saddle portion.

9. The airfoil array of claim 1, wherein the outer section defines a radially outwardly facing ledge.

10. A turbine engine airfoil structure comprising:

an airfoil adapted to be supported to extend across a gas passage for a hot working gas in a turbine engine, the airfoil having a suction surface corresponding to an airfoil suction side and a laterally opposite pressure surface corresponding to an airfoil pressure side extending axially in chord between opposite leading and trailing edges;

a platform structure defining an endwall located at one end of the airfoil and positioned at a location forming a boundary of the gas passage;

a saddle portion associated with the suction surface, the saddle portion defining a contour having a first radially outer edge located on the suction surface and a second radially inner edge located radially inwardly from the radially outer edge; and wherein the contour comprises a curvature in a plane extending radially and generally perpendicular to the suction surface and passing through the saddle portion, the curvature being a convexly curved portion and being radially displaced from the endwall and defining an apex located between the radially outer and inner edges of the saddle portion, and the convexly curved portion extends an axial length of the saddle portion from an upstream location adjacent to an axial mid-point of the airfoil to a downstream location adjacent to the trailing edge of the airfoil, wherein the radially outer and inner edges of the contour diverge in a radial direction from a substantially common upstream point located adjacent to the midpoint of the airfoil and at a junction of the suction surface and the endwall, the radially outer and inner edges extending to a maximum radial dimension adjacent to the trailing edge; and wherein the radially inner edge of the saddle portion is located on the endwall, and a radial dimension of the contour, as measured from the inner edge to the outer edge of the saddle portion and lying in the plane extending radially and generally perpendicular to the suction surface, is equal to or greater than a lateral dimension of the contour, as measured from the suction surface to the radially inner edge on the endwall and lying in the plane extending radially and generally perpendicular to the suction surface.

11. The airfoil structure of claim 10, wherein the apex of the curvature defines a center of curvature lying in the plane extending radially and generally perpendicular to the suction surface, and the center of curvature is located laterally at or inwardly from the suction surface in a lateral direction toward the pressure surface; and wherein a distance between the apex and the center of curvature defines a radius of curvature having a radial component measured in a direction from the radially inner edge to the radially outer edge of the saddle portion and lying in the plane extending radially and generally perpendicular to the suction surface and a lateral component measured in a direction from the suction surface to the radially inner edge on the endwall and lying in the plane extending radially and generally perpendicular to the suction surface, wherein the lateral component of the radius of curvature is greater than the radial component.

12. The airfoil structure of claim 10, wherein the radially inner edge of the saddle portion is located radially at the suction surface at junction of the suction surface with the endwall.

13. The airfoil structure of claim 12, wherein the apex of the curvature defines a center of curvature lying in the plane extending radially and generally perpendicular to the suction surface, and the center of curvature is located radially outwardly from the endwall.

14. The airfoil structure of claim 12, wherein the curvature includes a convexly curved portion and a concavely curved portion located in radially spaced relation to each other.

15. The airfoil structure of claim 14, wherein at least one of the convexly curved portion and the concavely curved portion is located laterally between the suction surface and the pressure surface of the same airfoil.

16. The airfoil structure of claim 10, wherein a height of the saddle portion, defined as a lateral distance from the suction surface to the apex of the curvature defined by the contour, extends within a range between a maximum height that is about equal to a maximum thickness of the airfoil, defined by a maximum distance between the suction and pressure surfaces, and a minimum height that is about equal to a distance between the suction and pressure surfaces at the trailing edge.

17. The airfoil structure of claim 10, wherein the saddle portion comprises a first saddle portion, and the airfoil including a second saddle portion associated with the suction surface, the second saddle portion defining a second contour having a first radially outer edge located on the suction surface and a second radially inner edge located on the suction surface and located radially inwardly from the radially outer edge; and wherein the second contour comprises a second curvature in a plane extending generally perpendicular to the suction surface and passing through the second saddle portion, the second curvature defining an apex located between the radially outer and inner edges of the second saddle portion.

18. A turbine engine airfoil array comprising:

a laterally extending endwall with a series of airfoils projecting radially therefrom, each airfoil having a convex suction surface corresponding to an airfoil suction side and a laterally opposite concave pressure surface corresponding to an airfoil pressure side extending axially in chord between opposite leading and trailing edges;

the airfoils cooperating with the endwall to define a series of fluid flow passages for directing flow in a downstream direction from the leading edge toward the trailing edge;

a saddle portion associated with each suction surface, the saddle portion defining a contour having a first radially outer edge located on a respective suction surface and a second radially inner edge located on the respective suction surface and located radially inwardly from the radially outer edge;

wherein the contour comprises a curvature in a plane extending radially and generally perpendicular to the suction surface and passing through the saddle portion, the curvature being a convexly curved portion and defining an apex located between the radially outer and inner edges of the saddle portion; and the convexly curved portion extends an axial length of the saddle portion from an upstream location adjacent to an axial mid-point of the airfoil to a downstream location adjacent to the trailing edge of the airfoil, wherein the radially outer and inner edges of the contour diverge radially extending in the downstream direction, the radially outer and inner edges extending to a maxium radial dimension at a location adjacent to the trailing edge.

19. The airfoil array of claim 18, wherein the apex of the curvature defines a center of curvature lying in the plane extending radially and generally perpendicular to the suction surface; and wherein a distance between the apex and the center of curvature defines a radius of curvature having a radial component measured in a direction from the radially inner edge to the radially outer edge of the saddle portion and lying in the plane extending radially and generally perpendicular to the suction surface and a lateral component measured in a direction from the suction surface to the radially inner edge on the endwall and lying in the plane extending radially and generally perpendicular to the suction surface, wherein the lateral component of the radius of curvature is greater than the radial component.

* * * * *